United States Patent [19]

Conforti

[11] 4,097,850

[45] Jun. 27, 1978

[54] MEANS FOR ADJUSTING AND FOR TESTING A DETECTING DEVICE

[75] Inventor: Frederick J. Conforti, Aurora, Ill.

[73] Assignee: Pittway Corporation, Northbrook, Ill.

[21] Appl. No.: 737,388

[22] Filed: Nov. 1, 1976

[51] Int. Cl.[2] ..... G08B 29/00

[52] U.S. Cl. ..... 340/214; 250/381; 340/237 S

[58] Field of Search ..... 340/214, 237 S; 250/381

[56] References Cited

U.S. PATENT DOCUMENTS

| | | | |
|---|---|---|---|
| 3,500,368 | 3/1970 | Abe | 340/237 S |
| 3,564,524 | 2/1971 | Walthard et al. | 340/237 S |

FOREIGN PATENT DOCUMENTS

| | | | |
|---|---|---|---|
| 831,812 | 3/1960 | United Kingdom | 340/237 S |

*Primary Examiner*—John W. Caldwell, Sr.
*Assistant Examiner*—Daniel Myer
*Attorney, Agent, or Firm*—Gary, Juettner & Pyle

[57] ABSTRACT

A detecting device having a sensor responsive to the presence of predetermined phenomena to generate a signal which changes from a nominal value by an amount in accordance with concentrations of the phenomena, and circuitry connected with the sensor to monitor the signal and adjustable to generate an indication upon the signal changing by at least a selected first amount, is characterized by means for operating the sensor to selectively change the signal in the absence of the phenomena by either the first amount or by a second predetermined and greater amount. Where the detector is a fire detector, the phenomena to be sensed is products of combustion, and the signal changes by the first amount upon the presence of products of combustion in the minimum concentrationswhereat it is desired to generate an indication, and by the second amount upon the presence of products of combustion in the maximum concentrations which may occur before generation of an indication is necessary. With the signal selectively changed by the first amount in the absence of combustion, the monitoring and generating circuitry may be adjusted to provide the indication, whereby the sensitivity of the detector to combustion is adjusted. With the sensitivity adjusted, the detector may then be tested by selectively changing the signal by the second amount to cause the detector to respond as though combustion has occurred.

11 Claims, 1 Drawing Figure

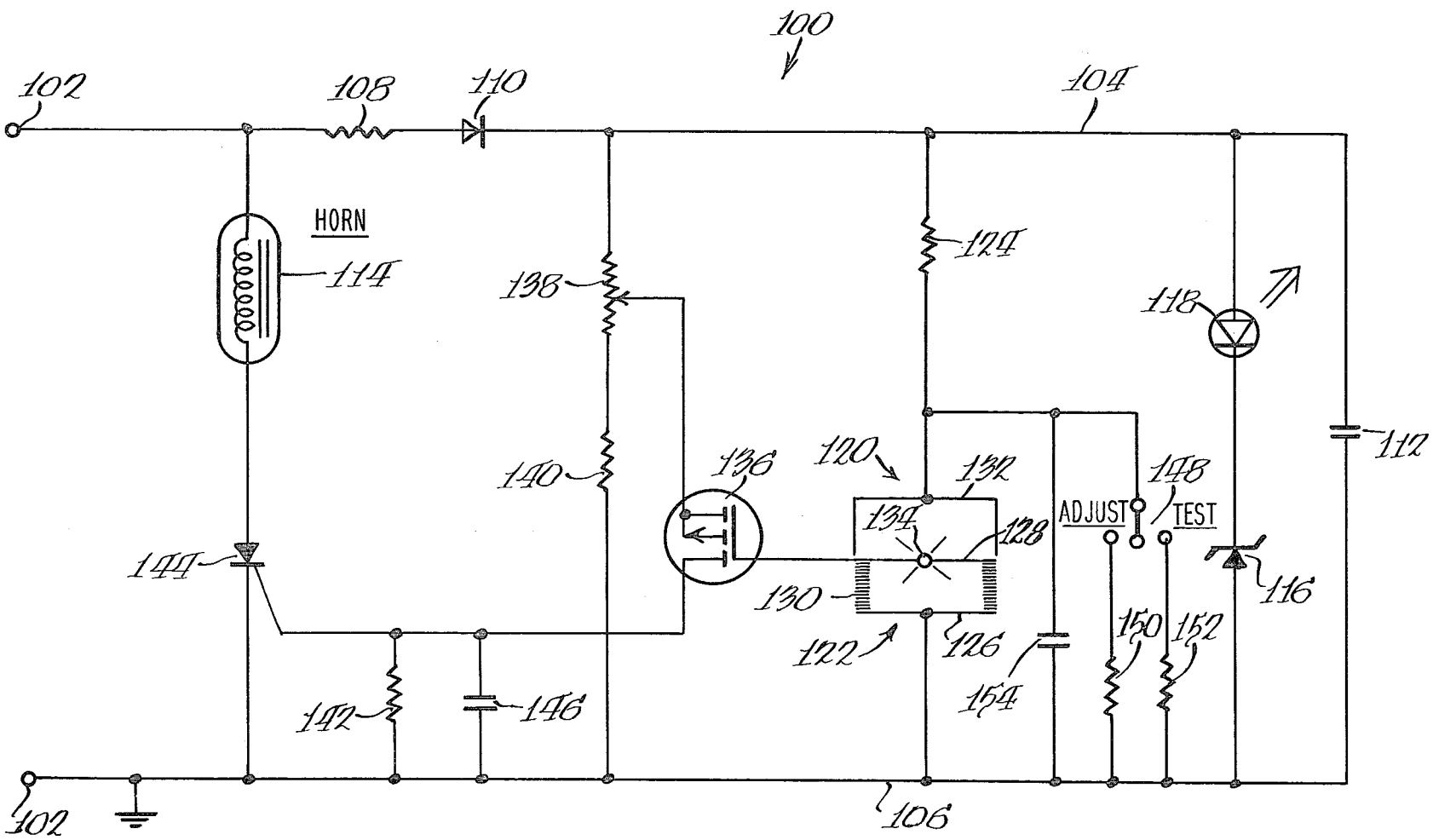
100
102
102
104
106
108
110
112
114
116
118
120
122
124
126
128
130
132
134
136
138
140
142
144
146
148
150
152
154
HORN
TEST
ADJUST

MEANS FOR ADJUSTING AND FOR TESTING A DETECTING DEVICE

BACKGROUND OF THE INVENTION

The present invention relates to adjusting and testing warning devices of the type having a sensor responsive to the occurrence of predetermined phenomena to generate a signal.

Detectors of the occurrence of predetermined phenomena, such as fire detectors for detecting the occurrence of combustion, employ some detecting means which generates a signal in response to the occurrence of the phenomena. The detecting means commonly comprises a sensor which changes its impedance in response to the presence of the phenomena, connected in series with a reference impedance to form a voltage divider across which a voltage is applied. In the absence of the phenomena the sensor has one impedance and the junction between the sensor and the reference impedance is at substantially a first potential. Upon the occurrence of the phenomena the sensor has another impedance, and the junction changes to a second potential. Circuitry is connected with the junction to monitor the potential thereat and to generate an indication of the occurrence of the phenomena upon the junction having at least the second potential.

Where the detector is a fire detector, the sensor is often an ionization chamber which is relatively open to ambient, or an active chamber. In such case, the reference impedance may advantageously be a second ionization chamber which is relatively closed to ambient, or a reference chamber. Each of the chambers includes a pair of spaced electrodes, or the chambers may share a common electrode therebetween, and means are provided, such as a source of radioactive energy, for ionizing air molecules between the electrodes. With the chambers in series to form the voltage divider, and with the voltage applied thereacross, an electric field is generated between the electrodes to establish a current flow through the chambers by movement of ions between the electrodes. The potential at the junction between the active and the reference chambers is then in accordance with the relative impedances of the chambers.

Changes in ambient conditions affect the ion current flow through the chambers, and therefore the impedances thereof. Natural changes in ambient conditions, such as changes in barometric pressure, temperature and relative humidity, occur slowly, and the reference chamber responds (changes its impedance) substantially in proportion to and simultaneously with the active chamber, and the chamber junction remains at essentially the first potential. For relatively rapid changes in ambient conditions, as occur upon combustion, products of combustion concentrate in the relatively open active chamber much more rapidly than in the relatively closed reference chamber. The products of combustion have a greater mass than air molecules, and upon entry into the active chamber they combine with the ionized air molecules therein and effectively reduce the current flow therethrough in accordance with their concentrations. This increases the impedance of the active chamber with respect to that of the reference chamber, and causes a change in the potential at the junction between the chambers. When products of combustion enter the active chamber in sufficient concentrations to cause the potential at the junction to change to at least the second potential, the junction voltage monitoring circuit generates the indication of combustion. For fire detectors, particularly of the type for use in single family residences, the indication is most often an audible alarm, such as the sounding of a horn.

The second potential at the chamber junction is that potential which exists when products of combustion are present in concentrations whereat it is desired to generate an alarm. Therefore, some means must be provided for adjusting the junction voltage monitoring circuit to generate the indication only when the junction voltage is at least equal to the second potential. Such means may comprise a potentiometer, adjustable to cause response of the voltage monitoring and indication generating circuit to a predetermined potential. However, to adjust the circuit to respond to the second potential, the second potential must generally first be provided at the chamber junction. This may be accomplished, for example, by exposing the detector to an atmosphere containing products of combustion in the minimum concentrations whereat it is desired to generate an alarm, and by then adjusting the circuit to cause the alarm. Such a technique is, at the very least, not only inconvenient, but also difficult if not impossible to accurately control.

Further, to afford users of such detectors some assurance of the operability thereof, means are generally provided whereby the detector may be tested. One known testing technique comprises sounding the detector horn by manually actuating a switch which directly connects the horn with the source of power for the detector. Unfortunately, while this type of test checks the operability of the horn and the sufficiency of the power supply, it does not check for or ensure proper operation of the chambers or of the chamber junction voltage monitoring circuit. Consequently, there is no assurance that the detector will respond to the occurrence of combustion.

With another known testing technique, an electrode of one of the ionization chambers is manually moved toward the other electrode of that chamber to decrease the spacing between the electrodes and to thereby change the impedance of the chamber with respect to the impedance of the other chamber. This changes the balance of the voltage divider formed by the chambers sufficiently to change the potential at the chamber junction to at least a value as would occur upon combustion, whereby the voltage monitoring circuit operates to generate an alarm. While this technique improves upon the aforementioned technique in that the junction voltage monitoring circuit is tested along with the horn and the sufficiently of the power supply, it does not provide an accurate test of the operability of the ionization chambers since the nature of the test requires a change in the geometry of one of the chambers. Under ambient conditions in the absence of combustion, the radiation within the chambers should provide a predetermined impedance relationship between the chambers. This impedance relationship, or the strength of the radiation within the chambers, is not tested where the geometry of one chamber, and therefore the impedance thereof, is changed to simulate an alarm condition. Further, after movement of one chamber electrode toward the other, it is possible for the moved electrode to fail to return to its original spacing from the other electrode, whereby the sensitivity of the detector will be changed. Should the sensitivity of the detector be decreased, combustion could reach an advanced state before being detected. Should the sensitivity of the detector be increased, an increased incidence of spurious or false alarms could be occasioned as, for example, by someone smoking a cigarette in close proximity with the detector.

A fire detector may, of course, be functionally tested by directing smoke thereat. However, such a test is inconvenient, and nevertheless does not ensure detector response to predetermined minimum concentrations of products of combustion, since precise control of the concentrations of products of combustion introduced into the sensor is generally impossible.

OBJECT OF THE INVENTION

The primary object of the present invention is to provide means for conveniently adjusting the sensitivity of, and for reliably testing all of the phenomena sensing and alarm generating components of, a warning device of a type responsive to the presence of predetermined phenomena to generate an alarm.

SUMMARY OF THE INVENTION

In accordance with the present invention a warning device, including detecting means responsive to the occurrence of predetermined phenomena to generate a signal having a nominal value in the absence of the phenomena and which changes in value upon the presence of and in accordance with the concentrations of the phenomena, has means for selectively changing the signal in the absence of the phenomena by either a first amount or by a second and greater amount.

More particularly, the detecting means includes a sensor, having an impedance which changes in response to the presence of and in accordance with the concentrations of the phenomena, connected in a series circuit with a reference impedance to form a voltage divider. The voltage divider is connected in series with a first impedance, and a voltage is applied across the voltage divider and the first impedance. The junction between the sensor and the reference impedance is at substantially a nominal potential in the absence of the phenomena, and changes by a first amount upon the presence of the phenomena in predetermined concentrations. Circuit means is connected with the junction to monitor the potential thereat, and is adjustable to generate an indication upon the potential changing by at least the first amount.

To adjust and to test the detector, the selectively changing means is operable to change the voltage across the sensor and reference impedance by amounts sufficient, in the absence of the phenomena, to change the potential at the junction therebetween by either the first or the second amount. This is accomplished most efficiently by selectively connecting either a second or a third impedance means in circuit across the sensor and reference impedance. The voltage divider formed by the sensor and reference impedance has an impedance approximately ten times greater than either the second or third impedance means, so that upon connection of one of the impedance means in circuit across the voltage divider the voltage thereacross is changed to substantially equal the voltage across the connected impedance means, the second and third impedance means being selected to change the voltage by the amounts sufficient to change the juncture voltage by either the first or the second amount.

As disclosed the detector is a fire detector, the phenomena to be detected is combustion, and the sensor and reference impedance junction voltage changes by at least the first amount upon the presence of products of combustion in the minimum concentrations whereat it is desired to generate an indication. To conveniently adjust the sensitivity of the detector, the means for changing is operated to change the voltage at the junction by the first amount in the absence of combustion, and the circuit means is then adjusted to generate the indication. Thereafter, to test the operability of the detector, the means for changing is operated to change the voltage at the junction by the second and greater amount to operate the detector in a manner as though combustion has occurred, the junction voltage during test of the detector being representative of the maximum concentrations of products of combustion which may occur before generation of an indication. The greater change in voltage at the bridge junction during testing, as compared with adjusting, of the detector thus establishes a range of sensitivity for the detector, and naturally occurring drifting or slight changes in the sensitivity of the detector do not cause apparent detector failure upon test until the sensitivity of the detector changes out of the established range.

The foregoing and other objects, advantages and features of the invention will become apparent from a consideration of the detailed description, when taken in conjunction with the appended drawing.

BRIEF DESCRIPTION OF THE DRAWING

The single drawing is a schematic illustration of a detecting device having adjusting and testing means in accordance with a preferred embodiment of the invention.

DETAILED DESCRIPTION

Referring to the drawing, there is shown a detector, indicated generally at 100, for sensing the occurrence of predetermined phenomena and for generating an indication thereof. In accordance with the invention, the detector includes means for adjusting the sensitivity thereof to the phenomena, and means for positively and reliably testing all phenomena sensing and indication generating components thereof in the absence of the phenomena, to ensure reliable operation of the detector upon the occurrence of the phenomena.

More particularly, the detector as shown is a.c. voltage powered, and includes a pair of terminals 102 for receiving and applying the voltage across a pair of conductor means 104 and 106, the conductor means 104 receiving the voltage through a resistor 108 and a diode 110. The diode 110 half wave rectifies the voltage, a capacitor 112 being provided to smooth voltage ripples. In the alternative, the detector may be powered by a d.c. voltage applied across the terminals, it only being required in such case that the audible alarm portion of the detector, shown as an a.c. powered horn 114, be replaced with a d.c. powered horn. In either event, means are provided, such as a zener diode 116, for regulating the voltage between the conductor means to a predetermined value, an LED 118 in series with the zener diode generating a visible indication of the application of power to the detector.

Where the detector is a fire detector, the phenomena to be sensed is combustion, and the combustion sensing portion of the detector includes a sensor, shown as an active ionization chamber 120, in series with a reference impedance, which is advantageously a reference ionization chamber 122, both chambers being connected in series with a resistor 124 between the conductor means. The reference chamber includes conductive electrodes 126 and 128 which are maintained in a spaced relationship by a spacer 130 of insulating material, the electrodes and the spacer together forming a relatively imperforate closure. The active chamber includes a relatively perforate conductive housing 132 forming one electrode thereof in a spaced relationship with the electrode 128, the electrode 128 forming the other electrode of the chamber and being common to both the active and the reference chambers. Means are provided, such as a radioactive source 134 positioned within a passage through the electrode 128, for ionizing air molecules within both of the chambers, whereby with a voltage applied across the electrodes 126 and 132 an electric field is generated within each chamber to establish a current flow therethrough by movement of the ions between the electrodes. The active and the reference chambers thus form a voltage divider, each chamber having an impedance of on the order of at least a magnitude greater than the impedance of the resistor 124, with a voltage at the electrode 128 at the juncture between the chambers therefore being substantially in accordance with the relative impedances of the chambers. In the alternative, the active and the reference chambers could be physically distinct ionization chambers connected in series without a common electrode therebetween, in which case the juncture between the chambers would still exhibit a voltage in accordance with the relative impedances of the chambers.

Changes in ambient conditions affect the ion current flow through the chambers, and therefore the impedances thereof. Natural changes in ambient conditions, such as changes in barometric pressure, temperature and relative humidity, occur slowly, and the relatively closed reference chamber responds (changes its impedance) to these changes substantially simultaneously and in proportion with the active chamber, and the voltage at the electrode 128 remains essentially constant. The reference chamber thus compensates the voltage divider circuit for slow changes in ambient conditions. For relatively rapid changes in ambient conditions, as occur with combustion, products of combustion concentrate in the relatively open active chamber much more rapidly than in the reference chamber. The products of combustion have a greater mass than air molecules, and upon entry into the active chamber they combine with the ionized air molecules therein to effectively reduce the current flow therethrough in accordance with their concentrations. The reduced current flow increases the impedance of the chamber and, for the circuit connections shown, causes a decrease in the voltage at the common electrode 128. A predetermined change in the voltage at the electrode may, then, be used as an indication of the occurrence of combustion.

Means for monitoring the voltage at the electrode 128 and for generating an indication upon a predetermined change in the value thereof includes a field-effect transistor (FET) 136 connected at its gate with the electrode. A potentiometer 138 and a resistor 140 are connected in series between the conductor means, and the drain-source circuit path of the FET is connected in series with a resistor 142 between a slider for the potentiometer and the conductor means 106. The potentiometer setting establishes a reference voltage for the FET and, as will be described, adjusts the sensitivity of the detector to products of combustion. For a given potentiometer setting the conductivity of the FET, and therefore the current flow therethrough and the voltage across the resistor 142, is determined by the voltage at the electrode 128, with a decrease in the value of the electrode voltage causing an increase in the conductivity of the FET, and therefore an increases in the voltage across the resistor 142. A silicon controlled rectifier (SCR) 144 is connected in series with the horn between the conductor means, and the gate of the SCR is connected to sense the voltage drop across the resistor 142 for having the SCR triggered into conduction thereby. A capacitor 146 in parallel with the resistor 142 prevents false triggering of the SCR.

Under ambient conditions in the absence of products of combustion, the electrode 128 is substantially at a nominal or first potential, and the potentiometer 138 is adjustable to control the current flow through the FET so that the voltage drop across the resistor 142 is less than sufficient to render the SCR conductive, whereby the horn is not sounded. Upon the occurrence of combustion, the relatively rapid increase in impedance of the active chamber, with respect to that of the reference chamber, causes a change or a decrease in the voltage at the electrode 128 by at least a predetermined amount to at least a second potential to increase the conductivity of the FET, and therefore the voltage drop across the resistor 142, sufficiently to trigger the SCR into conduction. This energizes the horn to sound an alarm, which continues until the active chamber is cleared of products of combustion to decrease the voltage across the resistor 142 to below the SCR trigger voltage. The SCR then becomes nonconductive to turn off the horn upon the a.c. voltage passing through its zero cross point. In the alternative, where the detector is d.c. powered the horn has contacts which repetitively make and break to sound the horn, and the SCR would become nonconductive upon the next opening of the horn contacts.

In accordance with the present invention, means for adjusting the sensitivity of the detector to products of combustion, and for testing the combustion detecting and alarm generating components of the detector, to ensure reliable operation of the detector in the event of combustion, includes means for selectively changing the voltage across the voltage divider formed by the active and the reference chambers by amounts sufficient to change the voltage at the electrode 128 by either a first predetermined amount or by a second and greater predetermined amount. As disclosed, the means for changing may include switch means, such as a manually operable switch 148, selectively connectable with either a first or a second impedance means, shown as resistors 150 and 152, in circuit across the active chamber electrode 132 and the reference chamber electrode 126. The impedance of the two chambers is ordinarily on the order of ten or eleven magnitudes, and the resistors 150 and 152 each have an impedance value which is at least one magnitude less than that of the chambers. Thus, upon operation of the switch to connect either the resistor 150 or 152 across the bridge, the connected resistor is placed in series with the resistor 124, and the voltage across the chambers is changed to equal the voltage developed across the connected resistor, a capacitor 154 being connected to smooth changes in voltage across the bridge.

To adjust the sensitivity of the detector to products of combustion one of the resistors, such as the resistor 150, is selected to have a value, along with the value of the resistor 124, to change the voltage across the ionization chambers by an amount sufficient to provide at the electrode 128 the first amount of change in voltage, which is exactly equal to that which would occur if products of combustion were present in the minimum concentrations whereat it is desirable to generate an alarm. With the value of the resistor so selected, and with the switch connecting the resistor across the chambers, the potentiometer 138 is then set to the point where the SCR 144 is just triggered into conduction, whereupon the sensitivity of the detector circuit is properly adjusted.

To test the operation of the detector after adjustment thereof, the other resistor 152 is selected to have a value, along with the value of the resistor 124, to change the voltage across the ionization chambers by an amount sufficient to provide at the electrode 128 the second and greater amount of change in voltage, which is equal to that which would occur if products of combustion were present in the maximum concentrations beyond which generation of an alarm is necessary. With the value of the resistor 152 so selected, and with the switch operated to connect the resistor across the chambers, conduction of the FET is increased to trigger the SCR to energize the horn. Thus, operation of the switch 148 to connect the resistor 152 across the bridge provides a change in the voltage at the electrode 128 as would occur upon combustion, and operates the entire combustion sensing and alarm generating portion of the detector to test the detector. As compared with prior detectors having test switches which ordinarily operate only the audible alarm of the detector to test the alarm and the sufficiency of the power supplied thereto, the switch 148 allows a user of the detector to conveniently, quickly and reliably test all components of the detector, a significant safety advantage.

It is to be appreciated that if the sensitivity of the detector were to remain essentially constant after adjustment, then the resistor 150, by itself, could be used to both adjust and test the detector. However, as a result of naturally occurring changes in the parameters of detector components, slight changes or drifting in the sensitivity of the detector is ordinarily experienced. Should the sensitivity decrease slightly to a level which is otherwise acceptable, i.e., a level less than that at which the detector was initially adjusted but at which an alarm will be generated in response to concentrations of products of combustion less than the maximum concentrations beyond which an alarm must be generated, use of only the resistor 150 to both adjust and to test the detector would result in an apparent failure of the detector upon test thereof. This would occur because the change in voltage at the electrode 128 provided by use of the resistor 150 would not, with decreased detector sensitivity, be sufficient to cause an alarm to be generated. The resistor 152, by providing a second and greater predetermined change in voltage at the electrode 128 than is provided by the resistor 150, thus compensates for reasonably expected changes in detector sensitivity, yet ensures that detector sensitivity does not decrease below a predetermined level. That is, the greater voltage change provided by use of the resistor 152 provides for generation of an alarm with slightly decreased detector sensitivity, yet is insufficient to cause generation of an alarm should the detector sensitivity decrease below the predetermined level, thus indicating either proper or improper operation of the detector.

With the resistor 152 selected to have the value described for testing of the detector, it is to be appreciated that the particular arrangement also tests the operation of the active and the reference chambers, and in particular the relative strengths of the radiation therein. For either a single source of radiation positioned in a passage through the common chamber electrode, or for separate sources of radiation positioned in each chamber, in the absence of combustion a predetermined impedance relationship should exist between the chambers. Thus, the voltage at the electrode 128 should change in fixed proportion to the change in the voltage across the chambers. As the impedance relationship of the chambers is known, absent changes in the relative strengths of the radiation within the chambers, operation of the switch 148 to connect the resistor 152 across the chambers should always provide a predetermined change in the voltage at the electrode 128. If the strength of the radiation in the reference chamber decreases sufficiently, resulting in an increase in the impedance thereof and a predetermined decrease in the sensitivity of the detector, operation of the switch will not cause the horn to be sounded, indicating to a user of the detector that servicing of the detector is required. Should the strength of the radiation in the active chamber decrease, the sensitivity of the detector will increase. In this case, closure of the switch will sound the horn, and will not indicate the decrease in radiation strength in the active chamber. However, the inability of the test means to detect this type of failure is not harmful, since the detector will still readily generate an alarm in response to minimum concentrations of products of combustion.

As disclosed, the switch 148 provides for connection of either or neither of the resistors 150 and 152 across the chambers. The adjustment of the sensitivity of the detector is normally a factory adjustment, and is not intended to be made by a user of the detector. Accordingly, the resistor 150 may, if desired, initially be connected directly across the series connected chambers in the manufacture of the detector, and later be severed or removed from in circuit thereacross after adjustment of the detector. In such case, the switch 148 would be operable to only selectively connect the resistor 152 across the chambers for testing the detector. Further, while resistors have been shown for being connected across the sensor and reference impedance, other suitable impedance means, such as one or more diodes connected to be forward biased and develop voltage drops thereacross, could be substituted for the resistors.

The invention thus provides improved means for adjusting and testing warning devices of a type having a sensor responsive to the presence of predetermined phenomena to generate a signal having a value in accordance with the presence and the concentrations of the phenomena.

While one embodiment of the invention has been described in detail, various modifications and other embodiments thereof may be devised by one skilled in the art without departing from the spirit and the scope of the invention, as defined by the appended claims.

What is claimed is:

1. In a warning device, detecting means responsive to the presence of predetermined phenomena, said detecting means having first and second electrodes for receiving a nominal value voltage thereacross and a third electrode exhibiting a voltage in accordance with said nominal value voltage in the absence of said phenomena and at least a first amount of change in voltage upon the presence of said phenomena in predetermined concentrations; means for applying said nominal value voltage across said first and second electrodes, and means for selectively changing the value of the voltage across said first and second electrodes either by one discrete amount sufficient in the absence of said phenomena to change the voltage at said third electrode by said first amount or by another discrete amount sufficient to change the voltage at said third electrode by a second and greater amount, said means for changing including first and second resistors each connected at one end with said second electrode, and a switch connected with said first electrode and opposite ends of said resistors and actuable to selectively connect either or neither of said resistors across said first and second electrodes, said first and second electrodes having said nominal value voltage thereacross when neither said first nor said second resistor is connected thereacross, said first resistor when connected across said first and second electrodes developing a voltage thereacross which changes the voltage across said electrodes by said one discrete amount sufficient to change the voltage at said third electrode by said first amount, said second resistor when connected across said first and second electrodes developing a voltage thereacross which changes the voltage across said electrodes by said another discrete amount sufficient to change the voltage at said third electrode by said second amount.

2. In a warning device, detecting means responsive to the presence of predetermined phenomena, said detecting means having first and second electrodes for receiving a nominal value voltage thereacross and a third electrode exhibiting a voltage in accordance with said nominal value voltage in the absence of said phenomena and at least a first amount of change in voltage upon the presence of said phenomena in predetermined concentrations; means for applying said nominal value voltage across said first and second electrodes, and means for selectively changing the value of the voltage across said first and second electrodes either by one discrete amount sufficient in the absence of said phenomena to change the voltage at said third electrode by said first amount or by another discrete amount sufficient to change the voltage at said third electrode by a second and greater amount, said means for changing including first and second impedance means, means for selectively connecting either or neither said first or said second impedance means in circuit across said first and said second electrodes, and a third impedance means connected with said first electrode, said means for applying said nominal value voltage applying a voltage across said third impedance means and said second electrode, said voltage across said first and second electrodes being at said nominal value when neither said first nor said second impedance means is connected in circuit thereacross, said first impedance means when connected in circuit thereacross being in series circuit with said third impedance means and having a value to develop a voltage thereacross to change said voltage across said first and second electrodes by said one discrete amount sufficient to change the voltage at said third electrode by said first amount, said second impedance means when connected in circuit thereacross being in series circuit with said third impedance means and having a value to develop a voltage thereacross to change said voltage across said first and second electrodes by said another discrete amount sufficient to change the voltage at said third electrode by said second amount.

3. In a warning device as set forth in claim 2, circuit means for monitoring the voltage at said third electrode and for generating an indication upon said voltage changing from said nominal value by at least said first amount, said circuit means generating said indication upon the presence of said phenomena in said predetermined concentrations, either said first or second impedance means when connected in circuit across said first and second electrodes causing operation of said circuit means to generate said indication.

4. In a warning device as set forth in claim 2, circuit means for monitoring the voltage at said third electrode and for generating an indication in response thereto, said circuit means being adjustable to generate said indication in response to said monitored voltage changing in value by at least a predetermined amount, said circuit means being adjustable to generate said indication when said first impedance means is connected in circuit across said first and second electrodes providing said first amount of change in voltage at said third electrode, whereby the sensitivity of said warning device to predetermined concentrations of said phenomena may be adjusted, said second impedance means when connected in circuit across said first and second electrodes causing operation of said circuit means to generate said indication to test said warning device.

5. In a warning device as set forth in claim 4, said predetermined phenomena being products of combustion, said means for selectively connecting including manually manipulable switch means connectable in circuit with said first and second impedance means between said first and second electrodes and operable to selectively connect either said first impedance means or said second impedance means in circuit across said electrodes.

6. In a warning device, means for detecting the occurrence of predetermined phenomena, said detecting means including sensor means having an impedance which changes in response to the presence and the concentrations of said phenomena, connected in series circuit with a reference impedance to form a voltage divider; means for applying a voltage across said voltage divider, the junction between said sensor means and said reference impedance being at substantially a nominal voltage in the absence of said phenomena and changing in voltage by at least a first amount upon the presence of said phenomena in predetermined concentrations, and means for selectively changing the voltage across said voltage divider either by one discrete amount sufficient in the absence of said phenomena to change the voltage at said junction by said first amount or by another discrete amount sufficient to change the voltage at said junction by a second and greater amount, said means for changing including first and second resistors each connected at one end to one end of said voltage divider, and a switch connected with an opposite end of said voltage divider and opposite ends of said resistors and actuable to selectively connect either or neither of said resistors across said voltage divider, said juncture voltage having said nominal value when neither said first nor said second resistor is connected across said voltage divider, said first resistor when connected across said voltage divider developing a voltage thereacross which changes the voltage across said voltage divider by said one discrete amount sufficient to change the voltage at said juncture by said first amount, said second resistor when connected across said voltage divider developing a voltage thereacross which changes the voltage across said voltage divider by said another discrete amount sufficient to change the voltage at said juncture by said second amount.

7. In a warning device, means for detecting the occurrence of predetermined phenomena, said detecting means including sensor means having an impedance which changes in response to the presence and the concentrations of said phenomena, connected in series circuit with a reference impedance to form a voltage divider; means for applying a voltage across said voltage divider, the junction between said sensor means and said reference impedance being at substantially a nominal voltage in the absence of said phenomena and changing in voltage by at least a first amount upon the presence of said phenomena in predetermined concentrations, and means for selectively changing the voltage across said voltage divider either by one discrete amount sufficient in the absence of said phenomena to change the voltage at said junction by said first amount or by another discrete amount sufficient to change the voltage at said junction by a second and greater amount, said means for changing the voltage across said voltage divider including first and second impedance means, and means for selectively connecting either or neither said first or said second impedance means in circuit with said voltage divider, and further including third impedance means connected in series circuit with said voltage divider, said voltage applying means applying said voltage across said third impedance means. and said voltage divider, said means for selectively connecting including switch means normally disconnecting both said first and second impedance means from in circuit with said voltage divider and operable to selectively connected either said first or said second impedance means in circuit across said voltage divider, said first or said second impedance means when connected in circuit across said voltage divider being connected in series circuit with said third impedance means, said first impedance means when so connected developing a voltage thereacross to change the voltage across said voltage divider by said one discrete amount sufficient to change the voltage at said junction by said first amount, said second impedance means when so connected developing a voltage thereacross to change the voltage across said voltage divider by said another discrete amount sufficient to change said junction voltage by said second amount.

8. In a warning device as set forth in claim 7, circuit means for monitoring the voltage at said junction and for generating an indication in response thereto, said circuit means being adjustable to generate said indication in response to said monitored voltage changing from said nominal value by at least a predetermined amount, said circuit means being adjustable to generate said indication when said first impedance means is connected in circuit across said voltage divider providing said first amount of change in voltage at said junction, whereby the sensitivity of said warning device to said predetermined concentrations of said phenomena may be adjusted, said junction potential changing from said nominal value by said second amount upon the presence of said phenomena in predetermined maximum concentrations in response to which said indication must be generated, said second impedance means when connected in circuit across said voltage divider causing operation of said circuit means to generate said indication to test said warning device.

9. In a warning device as set forth in claim 8, said switch means being a manually manipulative switch.

10. In a warning device as set forth in claim 8, said predetermined phenomena being products of combustion, said sensor means being an ionization chamber which is relatively open to ambient.

11. In a fire detector, means for detecting the presence of products of combustion, said detecting means including sensor means having an impedance which changes in response to the presence and the concentrations of products of combustion, connected in series circuit with a reference impedance to form a voltage divider; means for applying a voltage across said voltage divider, the junction between said sensor means and said reference impedance having substantially a nominal potential in the absence of combustion and changing by at least a first amount upon the occurrence of products of combustion in predetermined concentrations; a semiconductor device having a pair of controlled electrodes and a control electrode for controlling the conductivity between said controlled electrodes, said control electrode being connected with said junction; means for applying an adjustable reference potential across said controlled electrodes, said current flow between said controlled electrodes then being in accordance with the values of said reference potential and said junction potential; means responsive to the current flow between said controlled electrodes for generating an indication when said current flow has a predetermined value, and means for selectively changing the potential across said voltage divider either by one discrete amount sufficient in the absence of products of combustion to change the potential at said juncture from said nominal value by said first amount or by another discrete amount sufficient to change said juncture potential from said nominal value by a second and greater amount, said reference potential upon said changing means changing said junction potential by said first amount being adjustable to provide said predetermined value current flow, whereby said detector may be adjusted to generate said indication in response to at least said predetermined concentrations of products of combustion, said voltage divider junction changing from said nominal potential by said second amount in response to the presence of products of combustion in the maximum concentrations whereat said indication must be generated, whereby upon said changing means changing the potential at said junction from said nominal value by said second amount said indication is provided to test said detector.

* * * * *